US011643885B2

(12) United States Patent
Gomez et al.

(10) Patent No.: US 11,643,885 B2
(45) Date of Patent: May 9, 2023

(54) TUBULAR GRIPPING APPARATUS

(71) Applicant: Weatherford Technology Holdings, LLC, Houston, TX (US)

(72) Inventors: Ruben Gomez, Houston, TX (US); Kevin Thomas Page, Tomball, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 17/216,313

(22) Filed: Mar. 29, 2021

(65) Prior Publication Data

US 2022/0307333 A1 Sep. 29, 2022

(51) Int. Cl.
*E21B 19/10* (2006.01)

(52) U.S. Cl.
CPC ..... *E21B 19/10* (2013.01)

(58) Field of Classification Search
CPC ..... E21B 19/10; E21B 19/102; E21B 19/06; E21B 19/07
See application file for complete search history.

(56) References Cited

U.S. PATENT DOCUMENTS 2,156,384 A * 5/1939 Fluellen ..... E21B 19/10 175/423
3,457,605 A 7/1969 Kingsbury et al.
4,389,760 A * 6/1983 Krasnov ..... E21B 19/10 188/67
2006/0254866 A1 11/2006 Shahin
2013/0186640 A1* 7/2013 Webre ..... E21B 19/08 166/85.5
2015/0275592 A1 10/2015 Wood
2015/0315855 A1* 11/2015 Dewald ..... E21B 33/0422 166/250.01
2016/0168928 A1* 6/2016 Magnuson ..... E21B 19/10 166/244.1

FOREIGN PATENT DOCUMENTS

EP 2564015 A1 3/2013

OTHER PUBLICATIONS

International Search Report and Written Opinion in related application PCT/US2022/070246 dated Mar. 14, 2022.

* cited by examiner

*Primary Examiner* — Blake Michener
(74) *Attorney, Agent, or Firm* — Smith IP Services, P.C.

(57) ABSTRACT

A tubular gripping apparatus includes a housing having a bore and a plurality of gripping members movable between a gripping position and a release position. The apparatus may also include a shield having a tubular inner body movable relative to an outer body. The tubular inner body is movable between a retracted position, in which the tubular inner body is positioned above the plurality of gripping members, and an extended position, in which the inner body is at least partially positioned interiorly of the plurality of gripping members.

20 Claims, 11 Drawing Sheets

TUBULAR GRIPPING APPARATUS

BACKGROUND

Field

Embodiments of the present disclosure generally relate to a tubular gripping apparatus. More particularly, embodiments of the present disclosure relates to a tubular gripping apparatus, such as a spider, having a shield for protecting the slips.

Description of the Related Art

The handling and supporting of tubular pipe strings has traditionally been performed with the aid of wedge shaped members known as slips. In some instances, these members operate in a tubular gripping apparatus, such as an elevator or a spider. Typically, an elevator or a spider includes a plurality of slips circumferentially surrounding the exterior of the pipe string. The slips are disposed in a housing. The inner sides of the slips usually carry teeth formed on hard metal dies for engaging the pipe string. The exterior surface of the slips and the interior surface of the housing have opposing engaging surfaces which are inclined and downwardly converging. The inclined surfaces allow the slip to move vertically and radially relative to the housing. In effect, the inclined surfaces serve as wedging surfaces for engaging the slip with the pipe. Thus, when the weight of the pipe is transferred to the slips, the slips will move downward with respect to the housing. As the slips move downward along the inclined surfaces, the inclined surfaces urge the slips to move radially inward to engage the pipe. In this respect, this feature of the spider is referred to as "self tightening/wedging effect." Further, the slips are designed to prohibit release of the pipe string until the pipe load is supported and lifted by another device.

In the makeup or breakup of pipe strings, the spider is typically used for securing the pipe string in the wellbore at a rig floor. Additionally, an elevator suspended from a rig hook includes a separately operable set of slips and is used in tandem with the spider. The elevator may include a self-tightening feature similar to the one in the spider. In operation, the spider holds the tubular string at an axial position while the elevator positions a new pipe section above the pipe string for connection. It is common to install centralizers on the pipe string to help centralize once the pipe string is in the wellbore. After completing the connection, the elevator pulls up on and bears the weight of the string thereby releasing the pipe string from the slips of the spider there below. The elevator then lowers the pipe string into the wellbore. Before the pipe string is released from the elevator, the slips of the spider are allowed to engage the pipe string again to support the pipe string. After the weight of the pipe string is switched back to the spider, the elevator releases the pipe string and continues the makeup or break out process for the next joint.

As the tubular string is run-in to the wellbore, the pipe string or the centralizers on the pipe string may contact the slips even though the slips are retracted. In some instances, the contact between the pipe string and the slips causes damage to the pipe string, the slips, or both.

There is a need, therefore, for apparatus and methods of protecting these components during a tubular running operation.

SUMMARY OF THE DISCLOSURE

In one embodiment, a tubular gripping apparatus includes a housing having a bore and a plurality of gripping members movable between a gripping position and a release position. The apparatus may also include a shield having a tubular inner body movable relative to an outer body. The tubular inner body is movable between a retracted position, in which the tubular inner body is positioned above the plurality of gripping members, and an extended position, in which the inner body is at least partially positioned interiorly of the plurality of gripping members.

In another embodiment, a method of running a tubular using a tubular gripping apparatus includes moving a plurality of gripping members of the tubular gripping apparatus to a release position. The tubular gripping apparatus has a shield having an inner body movable relative to an outer body. The method also includes lowering the inner body to an extended position interior of the plurality of gripping members in the release position and lowering the tubular into the tubular gripping apparatus. The method further includes raising the inner body to a retracted position above the plurality of gripping members and moving the plurality of gripping members to a gripping position to retain the tubular in the tubular gripping apparatus.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
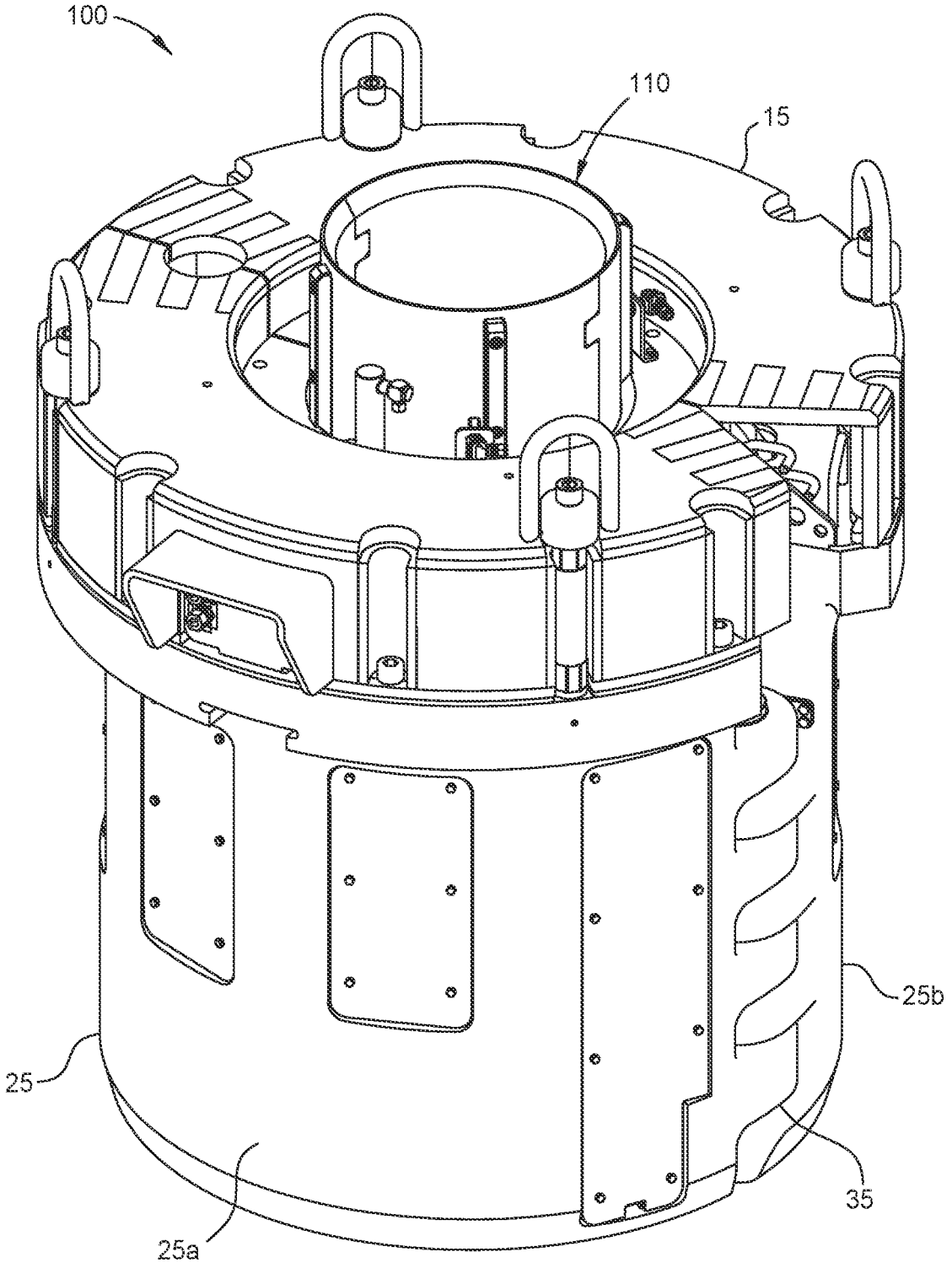
FIG. 1 is an isometric view of an exemplary spider, according to embodiments of the present disclosure.
Figure 2:
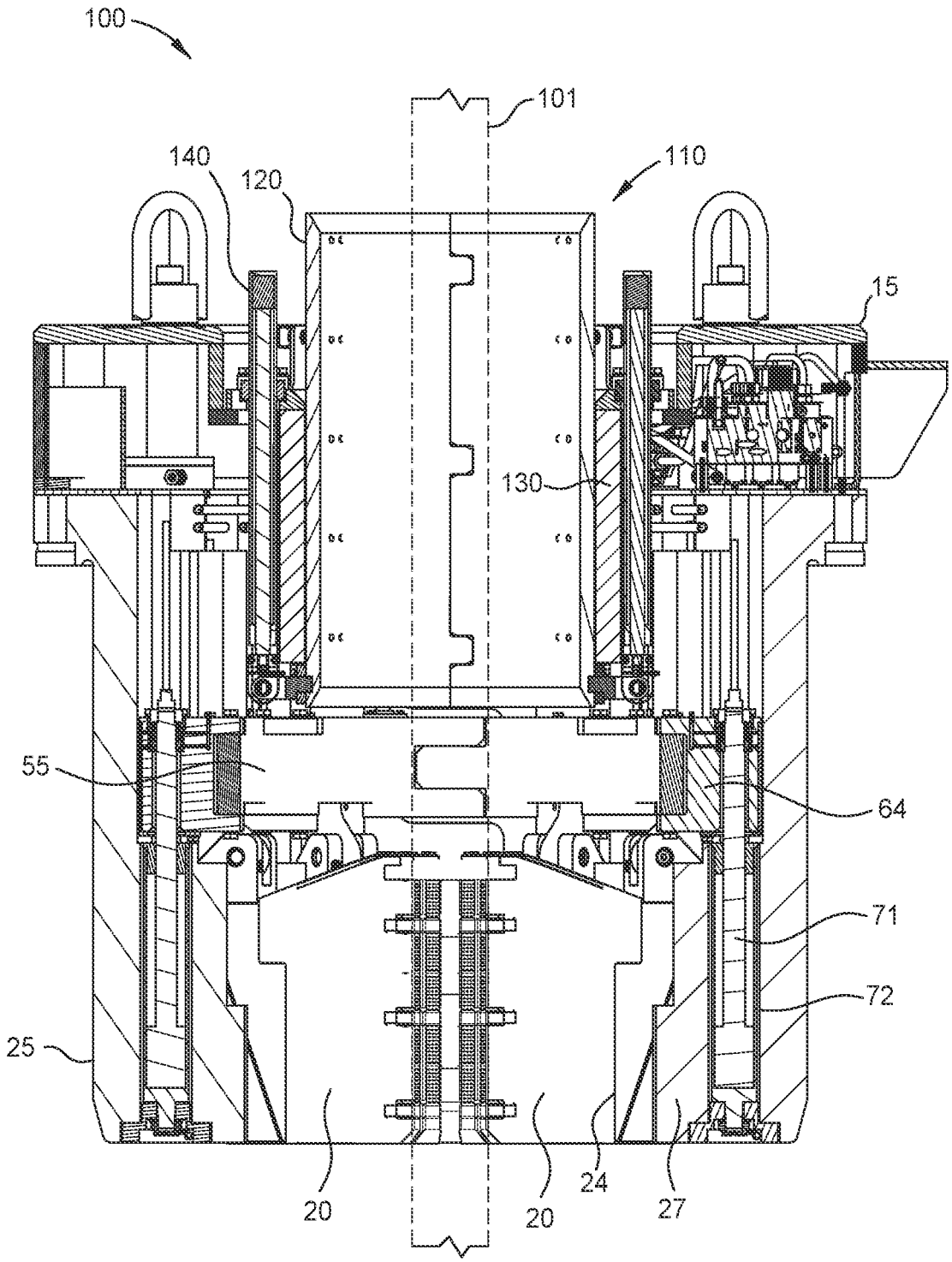
FIG. 2 is a cross-sectional view of the spider of FIG. 1 in which the slips are in the closed position.
Figure 3A:
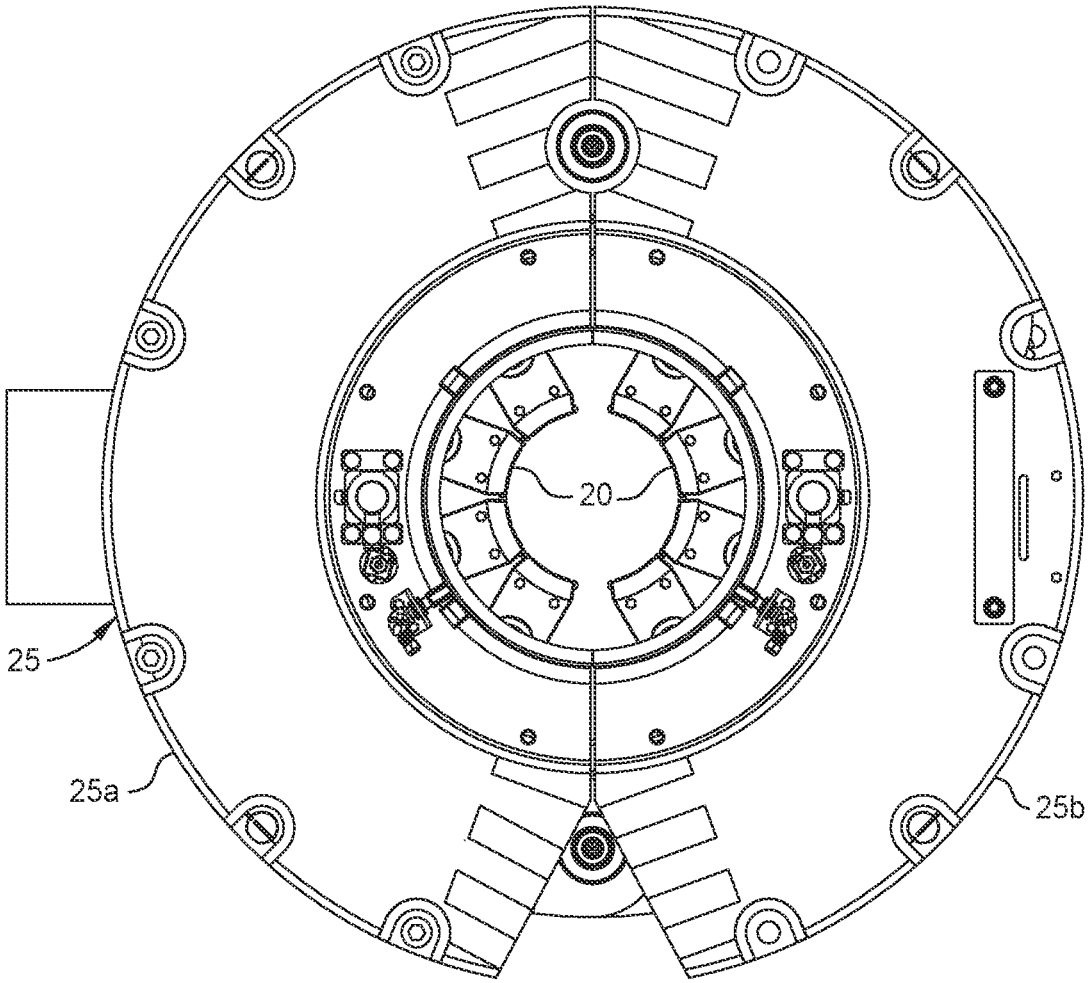
FIG. 3A is a top view of the spider of FIG. 1.
Figure 3B:
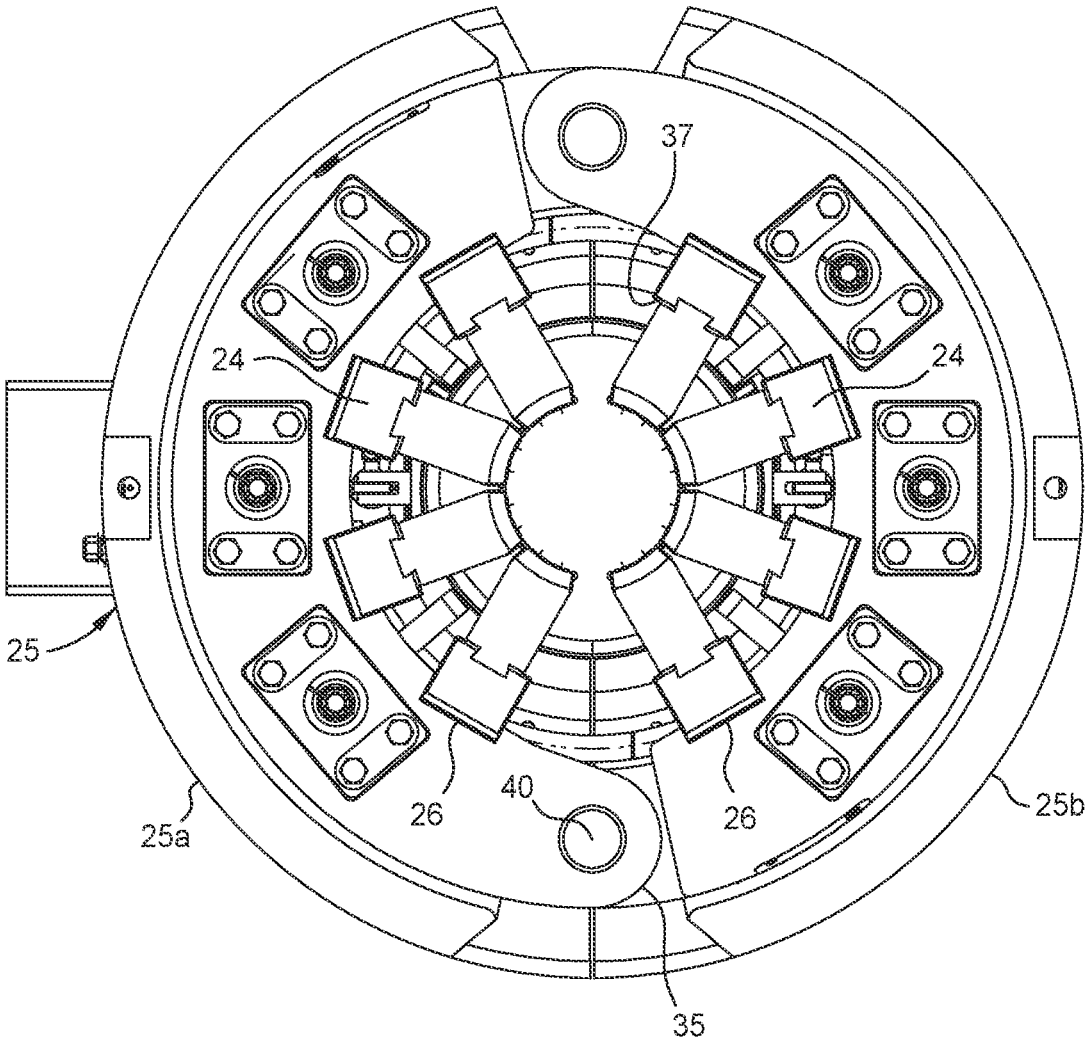
FIG. 3B is a bottom view of the spider of FIG. 1.
Figure 4:
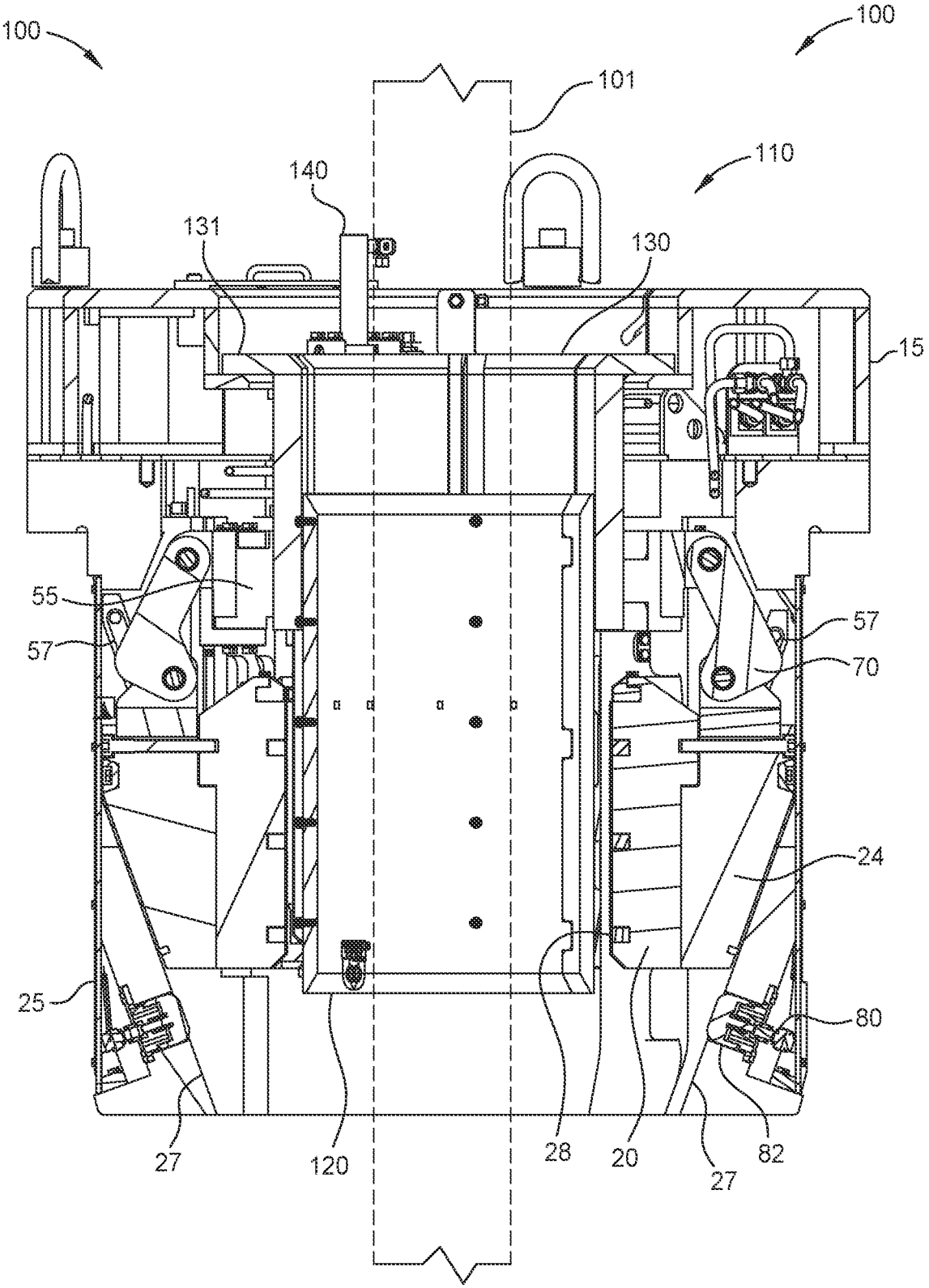
FIG. 4 is a cross-sectional view of the spider of FIG. 1 in which the slips are in the open position.

FIG. 1 is a perspective view of an exemplary tubular gripping apparatus, according to embodiments of the present disclosure. As shown, the tubular gripping apparatus is a spider 100 suitable for use with a rotary table (not shown). Alternatively, the spider 100 may be fitted for use with an elevator or a top drive casing make up system. FIG. 2 is a cross-sectional view of the spider 100 of FIG. 1 in which the slips are closed. FIGS. 3A and 3B are top and bottom views, respectively, of the spider 100 of FIG. 1. FIG. 4 is a cross-sectional view of the spider 100 of FIG. 1 in which the slips are open.

The spider 100 includes a housing 25 for housing one or more gripping members, such as slips 20, a cover assembly 15, and a shield 110. The housing 25 of the spider 100 is formed by pivotally coupling two sections 25*a,b* using one or more connectors, preferably hinges 35 formed on both sides of each body section, to couple the two body sections together. The housing 25 includes a bore extending therethrough. Alternatively, the housing sections 25*a,b* may be hinged on one side and selectively locked together on the other side. A hole is formed through each hinge 35 to accommodate a pin 40 to couple the housing sections 25*a,b* together.

Figure 3C:
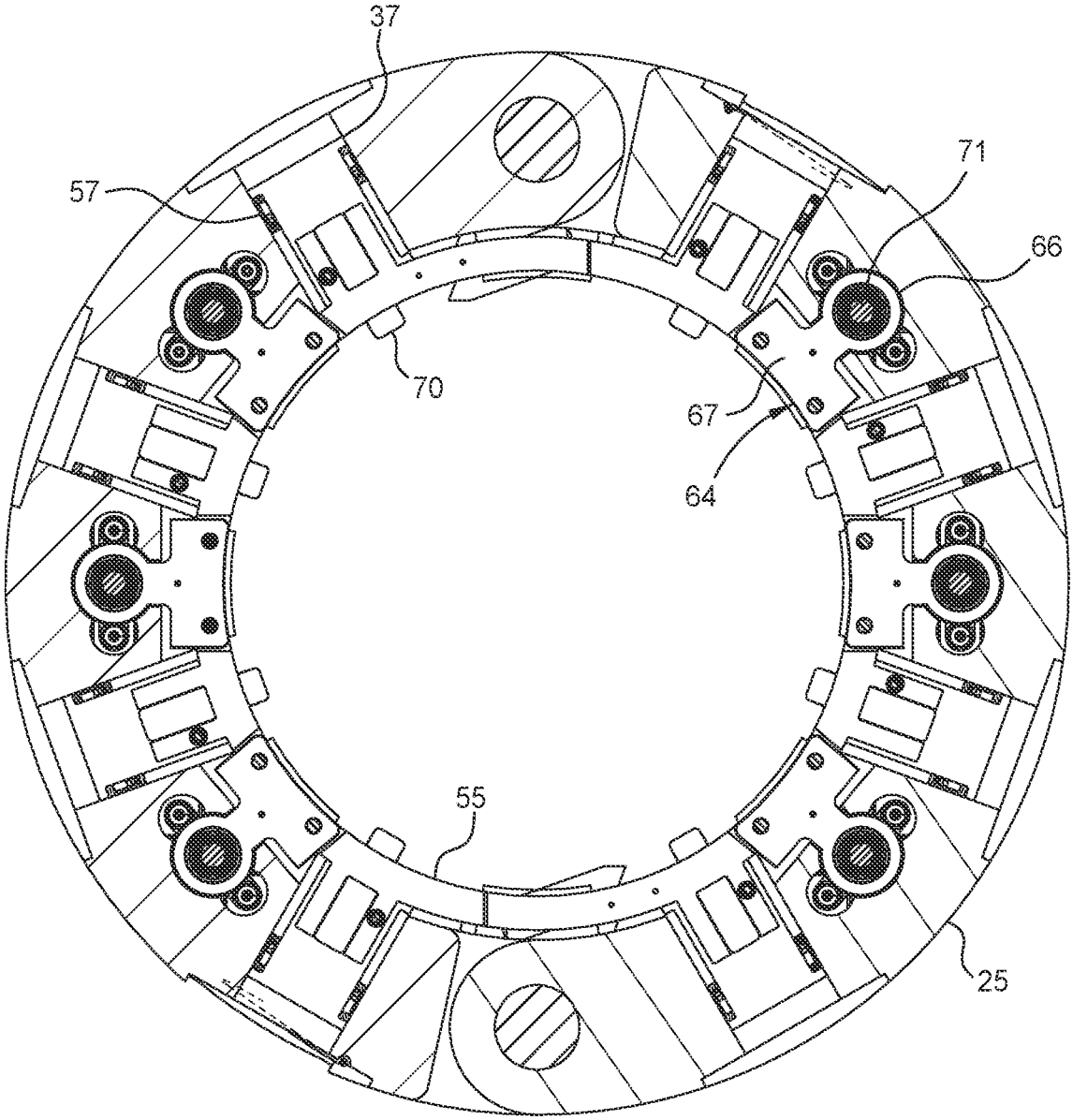
FIG. 3C is a top view of the leveling ring in the spider of FIG. 1.

In one embodiment, the slips 20 are attached to a carrier 24, as shown in FIG. 2. The carrier 24 is movable in a groove 26 formed in the housing 25, as shown in FIG. 3B. For example, the back of the slips 20 is attached to the interior surface of the carrier 24. The exterior surface of the carrier 24 has an inclined surface that is complementary to the inclined surface 27 of the housing 25. In one embodiment, the carrier 24 may include a guide member for guiding movement of the slip 20 relative to the housing 25. For example, the carrier 24 can include an inclined shoulder 37 (shown in FIGS. 3B and 3C) formed on the exterior of each side wall of the carrier 24, and the housing 25 can include side plates 57, shown in FIGS. 3C and 4. The inclined shoulder 37 engages the lower end of the side plates 57 and moves along the side plates 57 as the slips 20 are moved relative to the housing 25. In this manner, the guide member may maintain the path of a moving slip 20 along the inclined surface 27 of the housing 25. Alternatively, the carrier 24 and/or slip 20 can be coupled to the housing 25 using a pin and a guide slot connection. In another embodiment, the carrier 24 may be coupled to the housing 25 using a dovetail connection. Because the carrier 24 engages the housing 25, the carrier 24 allows the slips 20 to be exchanged more easily in response to changes in pipe sizes or damage to the slips 20. It is contemplated use of the carrier 24 can be optional in the embodiments described herein such that the back of the slips 20 has the inclined surface for engaging the inclined surface of the housing 25. Dies 28 having teeth may be disposed on the interior surface of the slips 20 for engaging the tubular. FIGS. 3A and 3B show eight slips 20 coupled to the body sections 25*a,b* of the spider 100. It contemplated the spider 100 may have a total of two or more slips 20, such as four, six, eight, ten, or twelve slips 20.

The spider 100 includes a leveling ring 55 for coupling the slips 20 together and synchronizing their vertical movement. The leveling ring 55 may include two sections coupled together. Each ring section is coupled to one of the housing sections 25*a,b* such that the leveling ring 55 can open and close with the housing 25. The slips 20 are pivotally coupled to a lower portion of the leveling ring 55. In some embodiments, a pivot arm 70 is connected between the leveling ring 55 and the carrier 24. The leveling ring 55 and the carrier 24 are pivotally connected to opposite ends of the pivot arm 70. Examples of the pivot arm 70 include a straight arm, an "L" shape arm, or other suitable configuration. The pivot arm 70 allows the carrier 24 and the slips 20 to move radially outward and upward along the inclined surface 27 of the housing 25 as the leveling ring 55 moves upward relative to the housing 25. It is contemplated the slips 20 can be coupled to the pivot arm 70 such that use of the carrier 24 is optional.

A plurality of cylinders 72 are used to move the leveling ring 55 vertically relative to the housing 25. As shown in FIG. 3B, three cylinders 72 are coupled to each section of the leveling ring 55. Although any suitable number of cylinders 72 may be used, such as one, two, four, five, or more. The cylinder 72 is attached to the lower portion of the housing 25, and the upper end of its piston rod 71 is attached to the leveling ring 55. In some embodiments, an optional ring connector 64 is used to couple the leveling ring 55 to the piston rod 71. In one example, the ring connector 64 includes side flanges 67 attached to the leveling ring 55 and a tubular body 66 disposed around the piston rod 71. FIG. 2 shows the piston rod 71 retracted in the cylinder 72, and the leveling ring 55 in a lower position. In this position, the slips 20 are in a gripping position, also referred to as a closed position. Extension of the piston rod 71 will move the leveling ring 55 to an upper position. In turn, the slips 20 are moved upward and radially outward along the inclined surface 27 of the housing 25 to a release position, also referred to as an open position. In some embodiments, one or more sensors are used to detect the position of the slips 20. For example, a weight sensor 80 can be installed on the inclined surface 27 of the housing 25. The weight sensor 80 is configured to detect a contact member 82 that is biased by a spring. The contact member 82 is depressed by a slip 20 as the slip 20 travels down the inclined surface 27 of the housing 25. When depressed, the contact member 82 can be detected by the weight sensor 80. In turn, the weight sensor 80 will send a signal indicating the slips 20 are in the closed position. An exemplary weight sensor is a proximity sensor configured to detect the contact member such as a Namur proximity sensor. Another example of a weight sensor is a hydraulic sensor such as a cam valve sensor.

The cover assembly 15 includes two separate sections, each attached above a respective housing section 25*a,b*. The sectioned cover assembly 15 allows the housing sections 25*a,b* of the spider 10 to open and close without removing the cover assembly 15. The sections of the cover assembly 15 form a hole to accommodate the pipe string and the centralizers.

Figure 5:
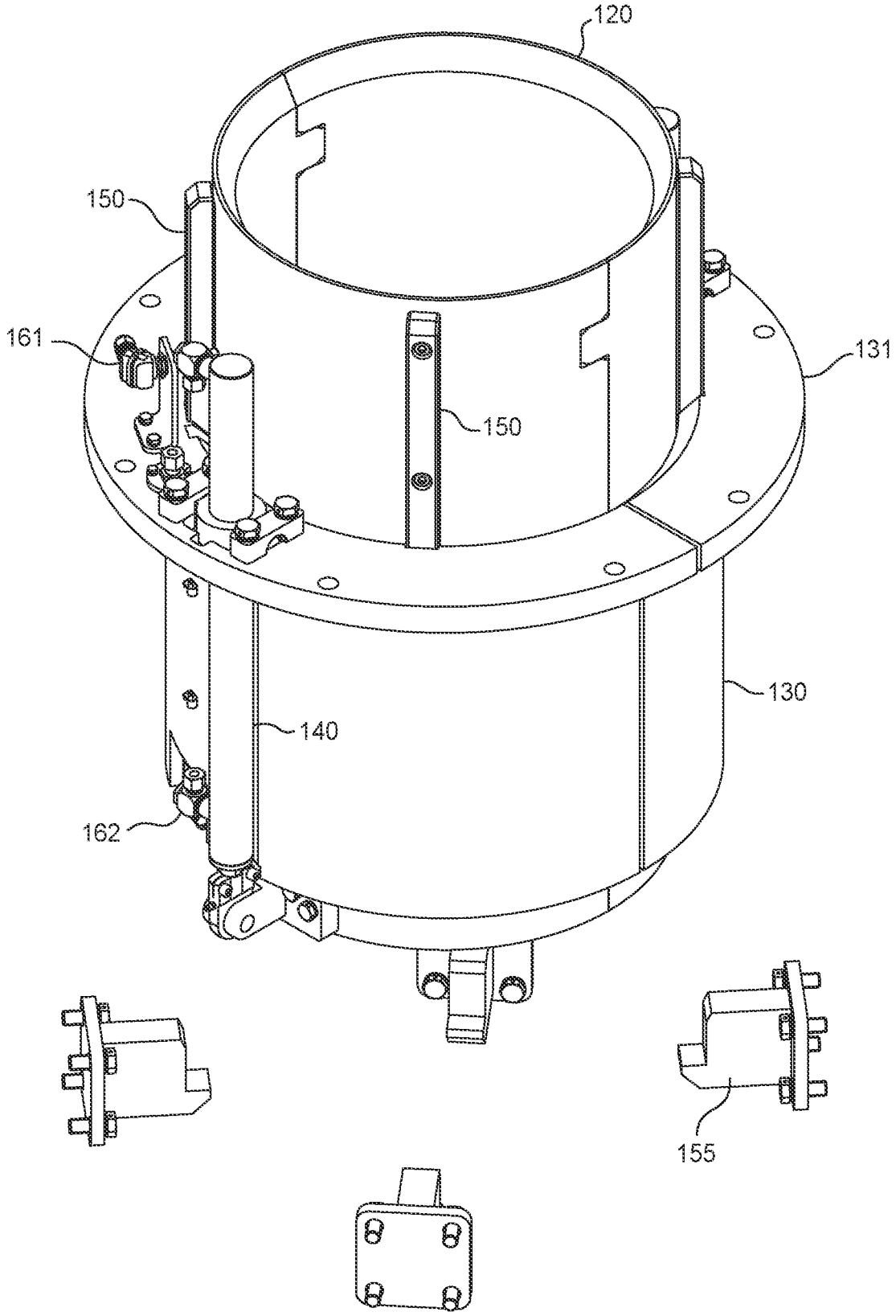
FIGS. 5 and 6 are different views of an exemplary shield suitable for use with the spider of FIG. 1. The shield is shown in a retracted position.
Figure 5A:
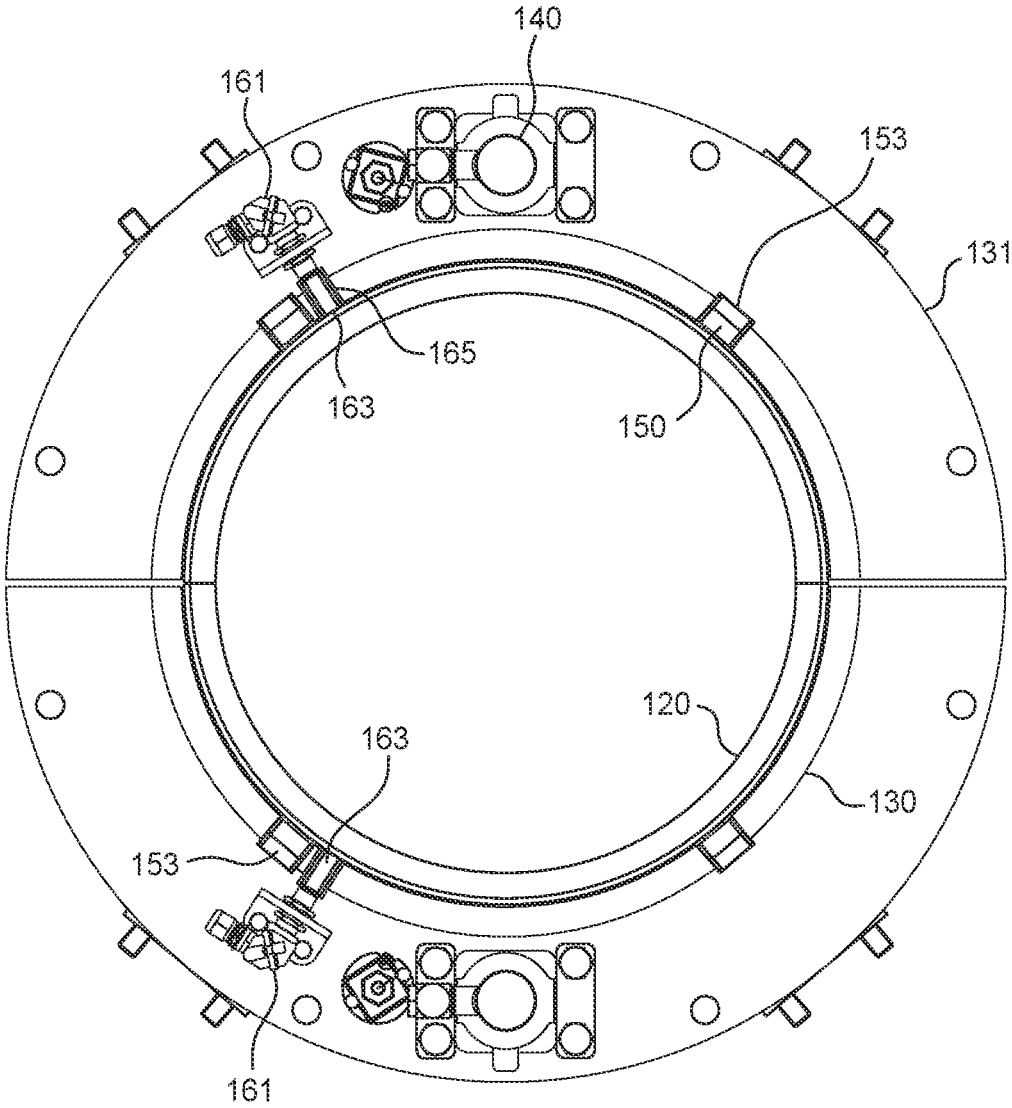
FIG. 5A is a top view of FIG. 5.
Figure 6:
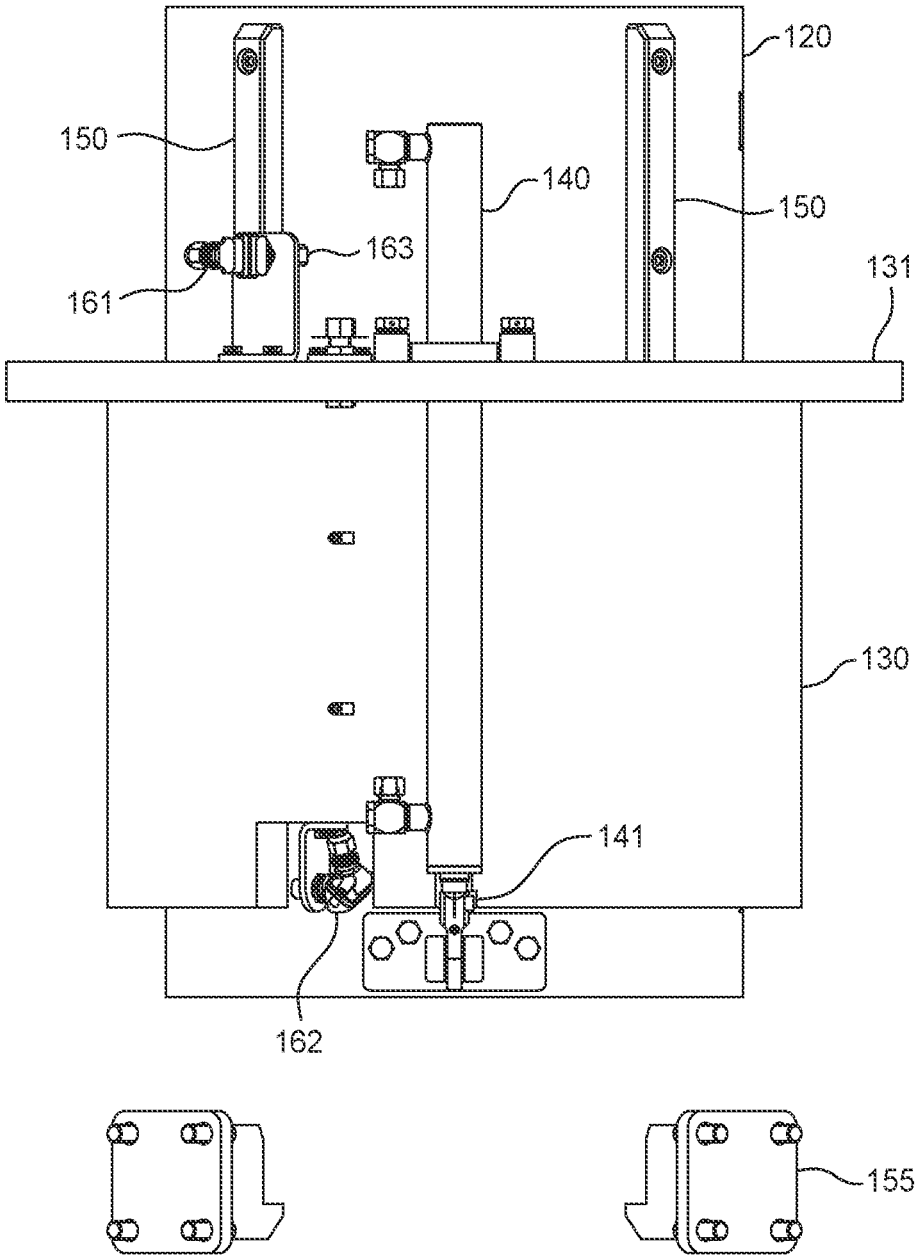
Figure 7:
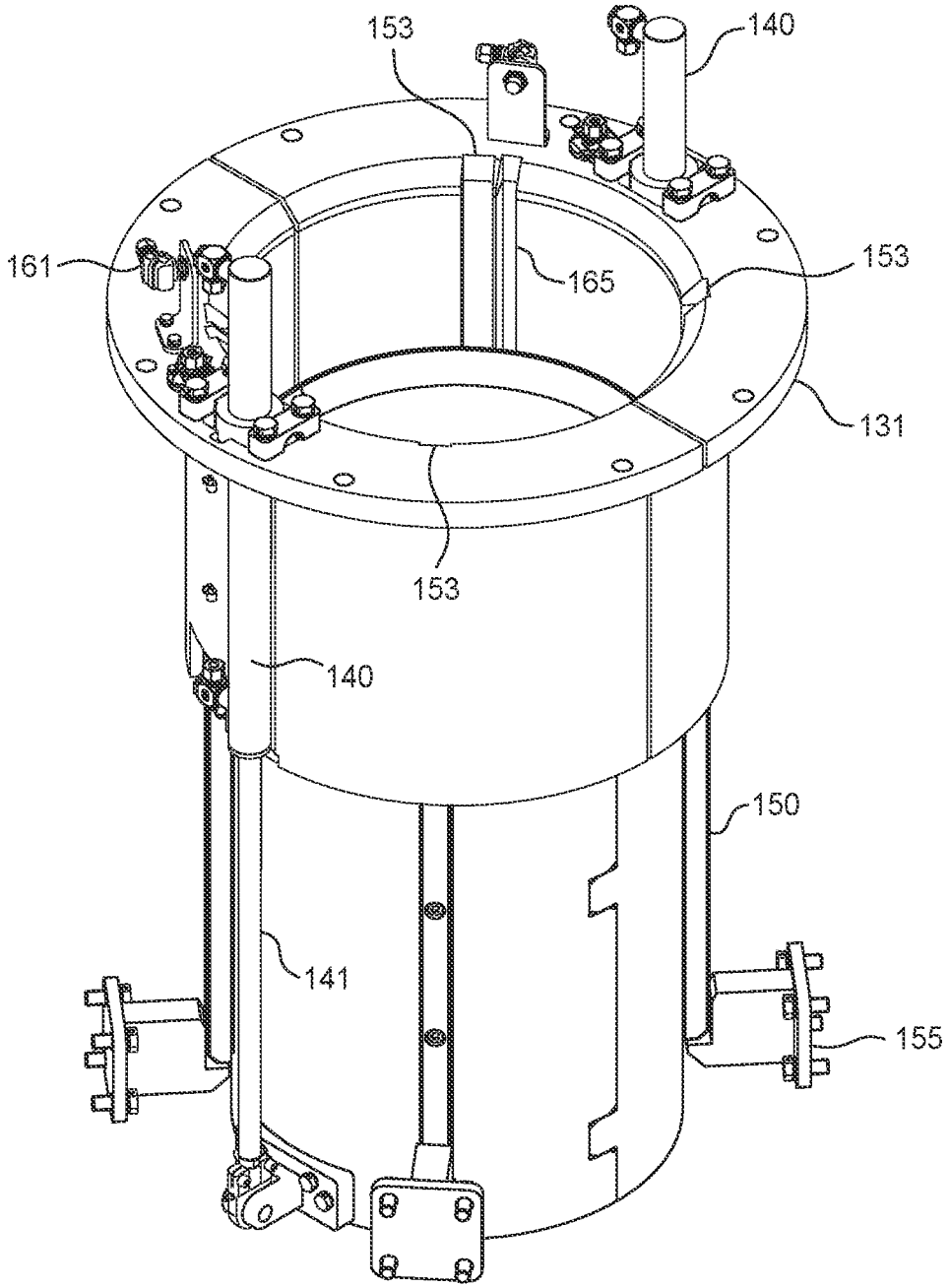
FIGS. 7 and 8 are different views of an exemplary shield suitable for use with the spider of FIG. 1. The shield is shown in an extended position.
Figure 8:
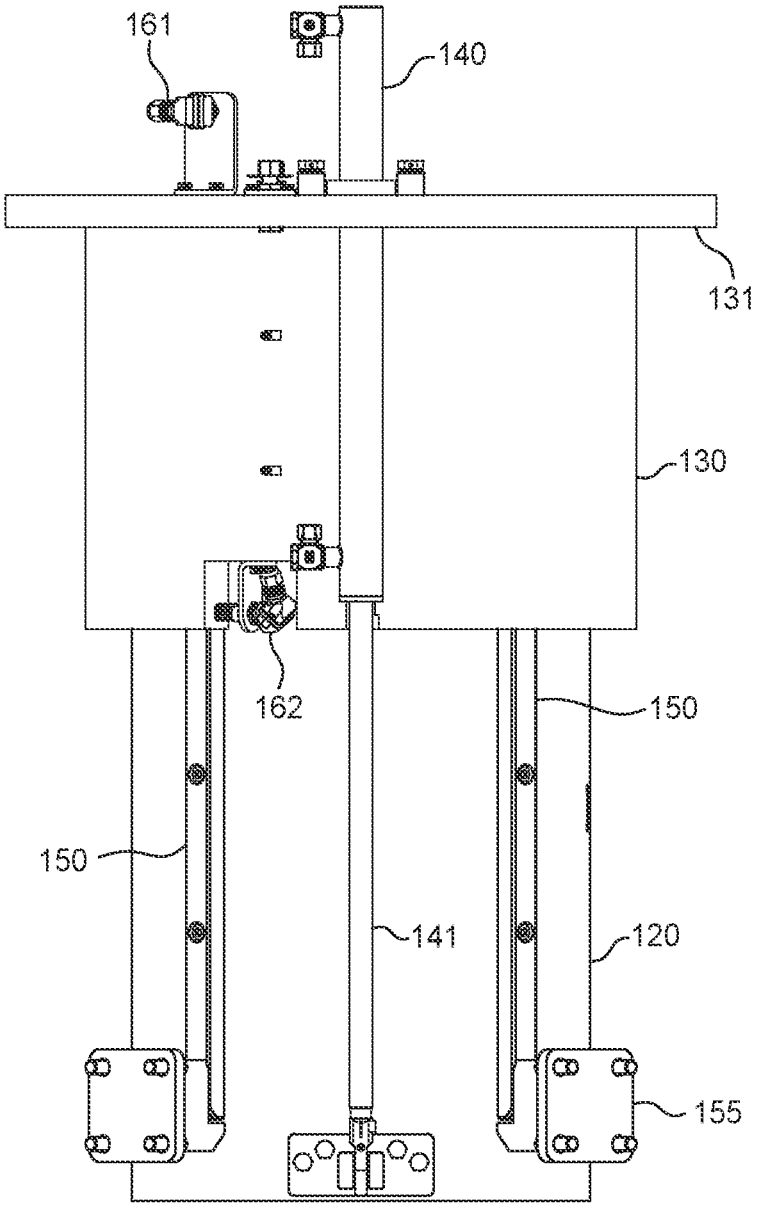

In some embodiments, the spider 100 includes a shield for protecting the slips 20. FIGS. 5-8 show an exemplary embodiment of the shield 110. The shield 110 includes an inner tubular body 120 disposed in an outer body 130 and movably coupled to the outer tubular body 130. FIGS. 5 and 6 are different views of the inner body 120 in a retracted position relative to the outer body 130. FIG. 5A is a top view of FIG. 5. FIGS. 7 and 8 are different views of the inner body 120 in an extended position relative to the outer body 130. The shield 110 is disposed inside the spider 100 and the bore of the shield 110 is preferably concentric with the bore in the spider 100. The outer body 130 includes a flange 131 for attachment to the spider 100. As shown in FIG. 2, the flange 131 is attached to the cover assembly 15 of the spider 100. In some embodiments, each of the inner body 120 and the outer body 130 includes two sections that are coupled together to form the tubular shaped bodies 120, 130. Each section of the bodies 120, 130 are attached to a respective section of the cover assembly 15 and can open and close with the spider 100.

The shield 110 includes two cylinders 140 for moving the inner body 120 axially relative to the outer body 130. As shown in FIGS. 5 and 6, the cylinders 140 are attached to the flange 131. The piston rod 141 of the cylinders 140 is attached to a lower portion of the inner body 120 and below the outer body 130. Each piston rod 141 is attached to one section of the inner body 120. Although two cylinders 140 are shown, it is contemplated one or more cylinders 140 may be used, such as one, three, four, five, or six cylinders. The cylinders 140 may be actuated using hydraulics, pneumatics, or electric. The piston rod 141 and the inner body 120 are shown in the retracted position. In this position, the inner body 120 is retracted above the slips 20, as shown in FIG. 2. Extension of the piston rod 141 will lower the inner body 120 to the extended position, as shown in FIGS. 7 and 8. In the extended position, the inner body 120 will be at least partially positioned inside the plurality of slips 20. FIG. 4 shows the inner body 120 in the extended position, and the slips 20 are disposed around the exterior of the inner body 120. In this manner, the inner body 120 can protect the slips 20 from contact with the tubular string or other tools being run into or out of the wellbore. The extended inner body 120 of the shield 110 is configured to extend into overlapping position with at least a majority portion of the length of the slips 20, such as seventy percent, eighty percent, or ninety percent or more of the length of the slips 20. In one embodiment, the inner body 120 protects the entire length of the slips 20. It is contemplated that other suitable actuators for moving the inner body 120 may be used, for example, a rack and pinion mechanism.

A plurality of guide bearings 150 are provided between the inner body 120 and the outer body 130 to facilitate movement of the inner body 120. In some embodiments, the guide bearings 150 are longitudinal rectangular bars attached to the exterior of the inner body 120. Each guide bearing 150 is movable in a channel 153 formed on the interior surface of the outer body 130. As shown, two guide bearings 150 are attached to each section of the inner body 120. It is noted that any suitable number of guide bearings 150 may be used, such as one, three, four, or five guide bearings. Also, it is contemplated that one or more of the guide bearings 150 may be attached to the interior of the outer body 130, and the respective channels 153 may be formed on the exterior surface of the inner body 120. Stop members 155 may be attached to the housing 25 to limit the downward movement of the inner body 120. The stop members 155 may engage the lower end of the guide bearings 150 and act as a lower limit for the guide bearings 150. Although each guide bearing 150 is shown with a respective stop member 155, it is contemplated the number of stop members 155 may be less than the number of guide bearings 150, such as one, two, or three stop members 155.

The shield 110 may include one or more sensors 161, 162 for indicating the position of the inner body 120 relative to the outer body 130. A first sensor 161 is used to indicate the inner body 120 is in the retracted position, and a second sensor 162 is used to indicate the inner body 130 is in the extended position. For example, the first sensor 161 can be attached to the flange 131, and the second sensor 162 can be attached to the lower portion of the outer body 130. In some embodiments, the sensors 161, 162 may be used to control movement of the inner body 120, such as stopping the inner body 120. Exemplary sensors 161, 162 may be proximity sensors selected from capacitive, inductive, photoelectric, magnetic, or ultrasonic type proximity sensors. In one example, the sensors 161, 162 are NAMUR proximity sensors. In some embodiments, suitable hydraulic sensors such as cam valve sensors can be used. The sensors 161, 162 are configured to detect a target 163, shown in FIG. 6, disposed on the inner body 120. The target 163 can move in a target slot 165, shown in FIG. 7, formed on the interior surface of the outer body 130. The target 163 is positioned on the inner body 120 such that it can be read by the first sensor 161 when the inner body 120 has reached the retracted position and by the second sensor 162 when the inner body 120 has reached the extended position.

In operation, an exemplary spider 100 equipped with a shield 110 may be used in a tubular running operation involving making up or breaking out one or more tubulars. FIG. 2 shows the slips 20 of the spider 100 in the closed position. In this position, the spider 100 is gripping a tubular string 101 in the wellbore. The weight sensor 80 is activated to indicate the slips 20 are in the closed position. The inner body 120 of the shield 110 is in the retracted position, in which the inner body 120 is raised above the slips 20.

A top drive casing make up tool may be used to make up a new joint of tubular to the tubular string 101. The casing make up tool may grab a new tubular joint and connect the tubular joint to the tubular string 101. After making up the tubulars and with the casing make up tool still retaining the new joint, a signal can be sent to open the slips 120. The slip cylinder 72 is activated to extend the piston rod 71 and raise the leveling ring 55. Upward movement of the leveling ring 55 causes the slips 20 to move upward and radially outward along the inclined surface 27 of the housing 25 toward the release position. After the slips 20 move up the inclined surface 27, the spring biases the contact member 82 outward, which indicates the slips 20 are no longer in the closed position. It is noted the leveling ring 55, optionally, has an inner diameter that is larger than the outer diameter of the outer body 130 so that the leveling ring 55 can be positioned around the outer body 130.

A signal is sent to activate the shield 110. The piston rods 141 attached to the inner body 120 are extended to lower the inner body 120. The inner body 120 is lowered to a position inside of the surrounding slips 20. As shown in FIG. 4, the inner body 120 has been extended downward to fully protect the slips 20 from contact with the tubular string 101. The slips 20 are positioned around the exterior of the inner body 120 and protected from contact with the tubular string 101 and the centralizers. When the inner body 120 reaches the extended position, the second sensor 162 will detect the target 163 on the inner body 120. In turn, the second proximity sensors 162 will send a signal indicating the inner body 120 has reached the extended position. In this position, the lower end of the guide bearings 150 may engage the stop members 155. See FIGS. 7 and 8.

The top drive casing make up tool is now allowed to lower the extended tubular string 101 through the spider 100. The shield 110 will prevent the tubular string 101 and any centralizers on the tubular string 101 from contacting the slips 20.

After lowering the tubular string 101, the shield 110 is deactivated by retracting the inner body 120. The inner body 120 is raise until the upper, first sensor 161 detects the target 163 on the inner body 120. See FIGS. 5 and 6.

Thereafter, a signal is sent to activate the slips 20. The slips 20 are moved downwardly and radially inward along the inclined surface 27 toward the tubular string 101. In the closed position, the slips 20 will grip the tubular string 101 and retains its weight. The slips 20 will also depress the contact member 82, thereby causing the weight sensor 80 to send a signal indicating the slips 20 are in the closed position. The casing make up tool can now release the tubular string 101 and used to bring the next tubular joint to be added to the tubular string 101.

In one embodiment, a tubular gripping apparatus includes a housing having a bore and a plurality of gripping members movable between a gripping position and a release position. The apparatus may also include a shield having a tubular inner body movable relative to an outer body. The tubular inner body is movable between a retracted position, in which the tubular inner body is positioned above the plurality of gripping members, and an extended position, in which the inner body is at least partially positioned interiorly of the plurality of gripping members.

In some embodiments, the tubular inner body is in the retracted position, the plurality of gripping members are in the gripping position.

In some embodiments, when the tubular inner body is in the extended position, the plurality of gripping members are in the release position.

In some embodiments, the shield includes a first sensor for detecting the inner body in the retracted position and a second sensor for detecting the inner body in the extended position.

In some embodiments, the shield includes a guide bearing disposed between the tubular inner body and the outer body.

In some embodiments, the shield includes a stop member for limiting downward movement of the guide bearing.

In some embodiments, the outer body includes a flange for attaching to a cover assembly.

In some embodiments, the tubular gripping apparatus includes a weight sensor for detecting the plurality of gripping members in the gripping position.

In some embodiments, the tubular gripping apparatus includes a leveling ring for moving the plurality of gripping members.

In some embodiments, the leveling ring has an inner diameter that is larger than an outer diameter of the outer body.

In some embodiments, the tubular gripping apparatus includes a cylinder for moving the plurality of gripping members, wherein the cylinder is attached to a lower end of the housing, and a piston rod of the cylinder is extended to move the plurality of gripping members to the release position.

In another embodiment, a method of running a tubular using a tubular gripping apparatus includes moving a plurality of gripping members of the tubular gripping apparatus to a release position. The tubular gripping apparatus has a shield having an inner body movable relative to an outer body. The method also includes lowering the inner body to an extended position interior of the plurality of gripping members in the release position and lowering the tubular into the tubular gripping apparatus. The method further includes raising the inner body to a retracted position above the plurality of gripping members and moving the plurality of gripping members to a gripping position to retain the tubular in the tubular gripping apparatus.

In some embodiments, the method includes using a first sensor of the shield to detect the inner body is in the retracted position.

In some embodiments, the method includes using a second sensor of the shield to detect the inner body is in the extended position.

In some embodiments, the method includes moving a guide bearing of the tubular inner body along the outer body.

In some embodiments, the method includes engaging a lower end of the guide bearing with a stop member.

In some embodiments, the method includes using a weight sensor to detect the plurality of gripping members in the gripping position.

In some embodiments, moving the plurality of gripping members includes moving a leveling ring axially relative to the inner body.

In some embodiments, the leveling ring has an inner diameter that is larger than outer diameter of the outer body.

In some embodiments, moving the leveling ring axially includes actuating a cylinder, wherein the cylinder is attached to a lower end of the housing, and a piston rod of the cylinder is extended to move the leveling ring upward relative to the inner body.

While the foregoing is directed to embodiments of the present disclosure, other and further embodiments of the disclosure may be devised without departing from the basic scope thereof, and the scope thereof is determined by the claims that follow.

The invention claimed is:

1. A tubular gripping apparatus, comprising:

a housing having a bore;

a plurality of gripping members movable between a gripping position and a release position; and a shield having a tubular inner body movable relative to an outer body, wherein the tubular inner body is movable between a retracted position, in which the tubular inner body is positioned above the plurality of gripping members, and an extended position, in which the inner body is at least partially positioned interiorly of the plurality of gripping members, wherein the shield is independently movable relative to the plurality of gripping members.

2. The tubular gripping apparatus of claim 1, wherein when the tubular inner body is in the retracted position, the plurality of gripping members are in the gripping position.

3. The tubular gripping apparatus of claim 2, wherein when the tubular inner body is in the extended position, the plurality of gripping members are in the release position.

4. The tubular gripping apparatus of claim 1, wherein the shield further comprises a first sensor for detecting the inner body in the retracted position and a second sensor for detecting the inner body in the extended position.

5. The tubular gripping apparatus of claim 1, wherein the shield further comprises a guide bearing disposed between the tubular inner body and the outer body.

6. The tubular gripping apparatus of claim 5, wherein the shield further comprises a stop member for limiting downward movement of the guide bearing.

7. The tubular gripping apparatus of claim 1, wherein the outer body includes a flange attached to a cover assembly.

8. The tubular gripping apparatus of claim 1, further comprising a weight sensor for detecting the plurality of gripping members in the gripping position.

9. The tubular gripping apparatus of claim 1, further comprising a leveling ring for moving the plurality of gripping members.

10. The tubular gripping apparatus of claim 9, wherein the leveling ring has an inner diameter that is larger than an outer diameter of the outer body.

11. The tubular gripping apparatus of claim 1, further comprising a cylinder for moving the plurality of gripping members, wherein the cylinder is attached to a lower end of the housing, and a piston rod of the cylinder is extended to move the plurality of gripping members to the release position.

12. A method of running a tubular using a tubular gripping apparatus, comprising:

moving a plurality of gripping members of the tubular gripping apparatus to a release position, the tubular gripping apparatus having a shield including an inner body movable relative to an outer body;

lowering the inner body to an extended position interior of the plurality of gripping members in the release position;

lowering the tubular into the tubular gripping apparatus;

raising the inner body to a retracted position above the plurality of gripping members; and moving the plurality of gripping members to a gripping position to retain the tubular in the tubular gripping apparatus.

13. The method of claim 12, further comprising using a first sensor of the shield to detect the inner body is in the retracted position.

14. The method of claim 12, further comprising using a second sensor of the shield to detect the inner body is in the extended position.

15. The method of claim 12, further comprising moving a guide bearing of the tubular inner body along the outer body.

16. The method of claim 15, further comprising engaging a lower end of the guide bearing with a stop member.

17. The method of claim 12, further comprising using a weight sensor to detect the plurality of gripping members in the gripping position.

18. The method of claim 12, wherein moving the plurality of gripping members comprises moving a leveling ring axially relative to the inner body.

19. The method of claim 18, wherein the leveling ring has an inner diameter that is larger than an outer diameter of the outer body.

20. The method of claim 18, wherein moving the leveling ring axially comprises actuating a cylinder, wherein the cylinder is attached to a lower end of the housing, and a piston rod of the cylinder is extended to move the leveling ring upward relative to the inner body.

* * * * *